United States Patent [19]

Skegin

[11] Patent Number: 4,729,078

[45] Date of Patent: Mar. 1, 1988

[54] EXTRUDED LAMP HOUSINGS

[76] Inventor: Maer Skegin, 1411 N. Poinsettia Pl. #206, Los Angeles, Calif. 90046

[21] Appl. No.: 42,683

[22] Filed: Apr. 27, 1987

[51] Int. Cl.[4] ..... F21V 29/00

[52] U.S. Cl. ..... 362/294; 362/373

[58] Field of Search ..... 362/294, 362, 368, 360, 362/373; 339/22 R; 174/48

[56] References Cited

U.S. PATENT DOCUMENTS

| | | | |
|---|---|---|---|
| 3,222,517 | 12/1965 | Peters | 362/360 |
| 4,189,709 | 2/1980 | Gosswiller | 362/362 |
| 4,447,859 | 5/1984 | Raczywski | 362/362 |
| 4,535,393 | 8/1985 | Aspenwall | 362/362 |
| 4,551,792 | 11/1985 | Hoke et al. | 362/362 |

*Primary Examiner*—William R. Cline
*Assistant Examiner*—Sue Hagarman
*Attorney, Agent, or Firm*—Natan Epstein

[57] ABSTRACT

Housings for high intensity lamps are assembled from extruded elements interlocking without fasteners. The assembled housings feature longitudinal ventilation slots for convective cooling of the fixture. The ventilation slots have grooved edges for receiving mounting hardware which can be continuously positioned at any point along the housing.

16 Claims, 22 Drawing Figures

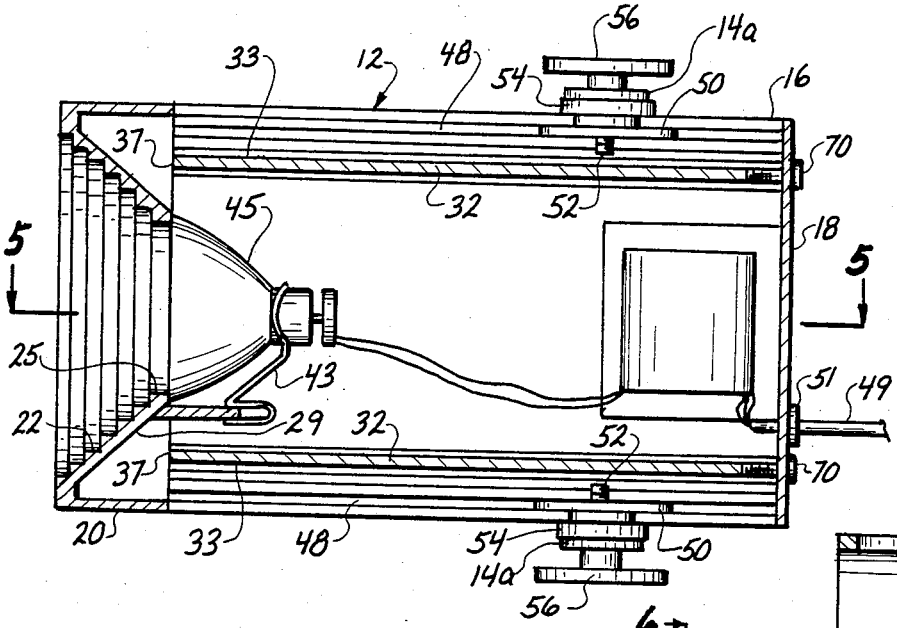
Fig. 4
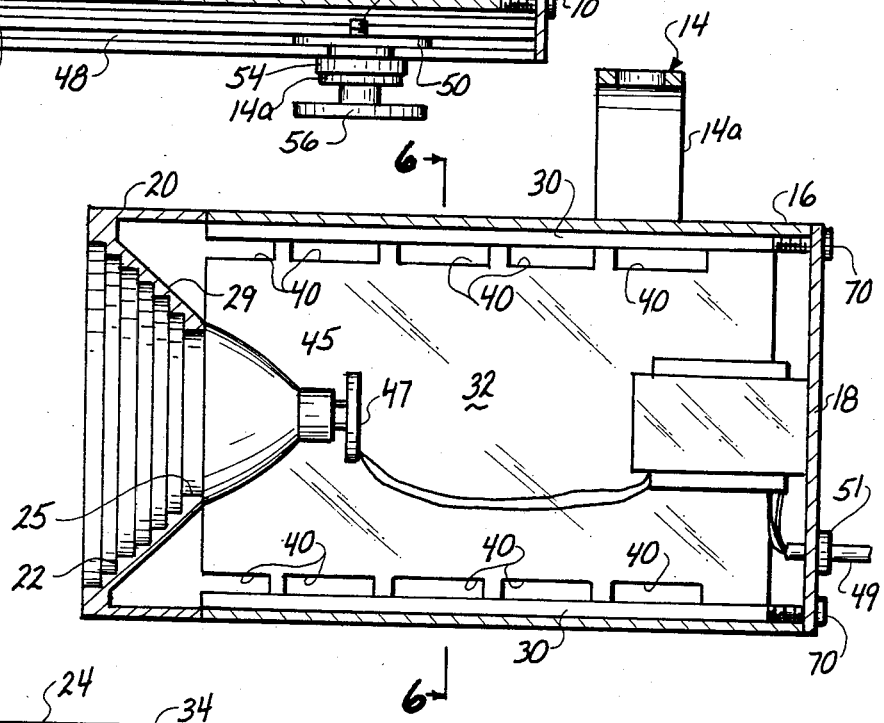
Fig. 5
Fig. 6
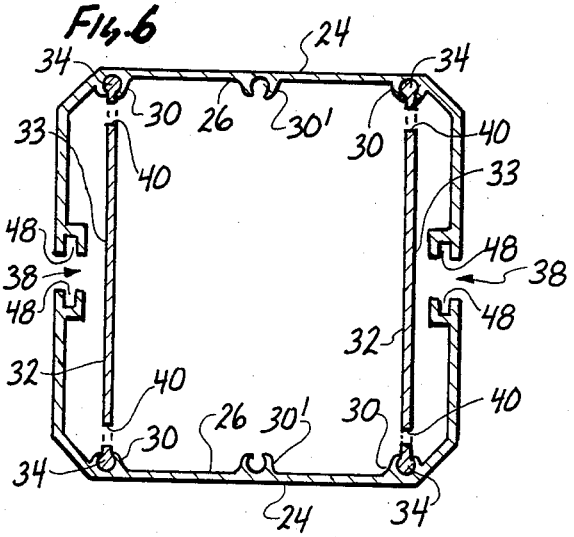
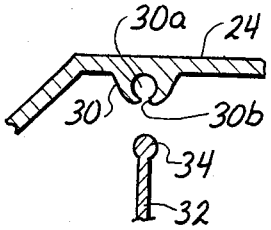
Fig. 6A

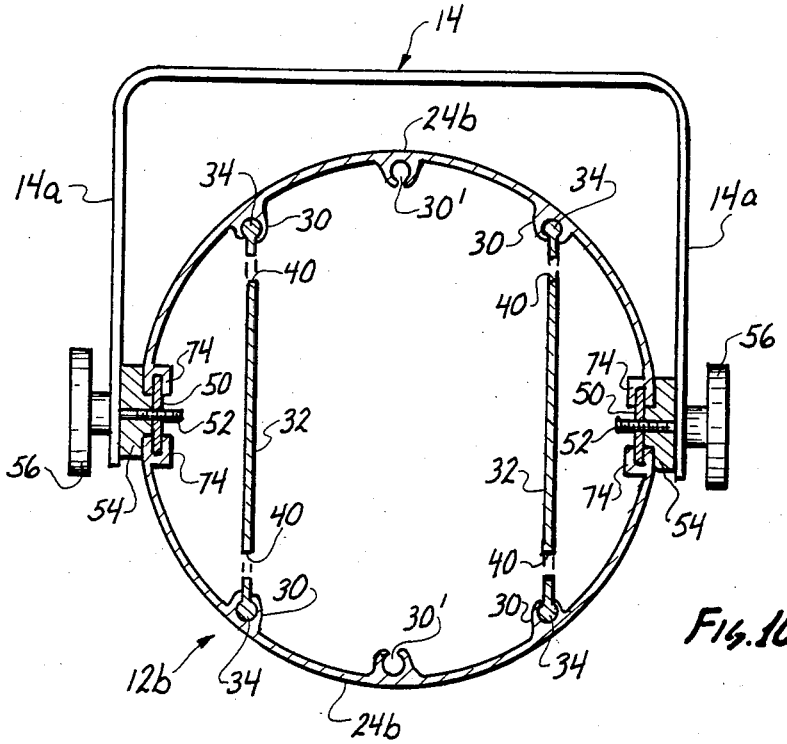
Fig. 10
Fig. 11
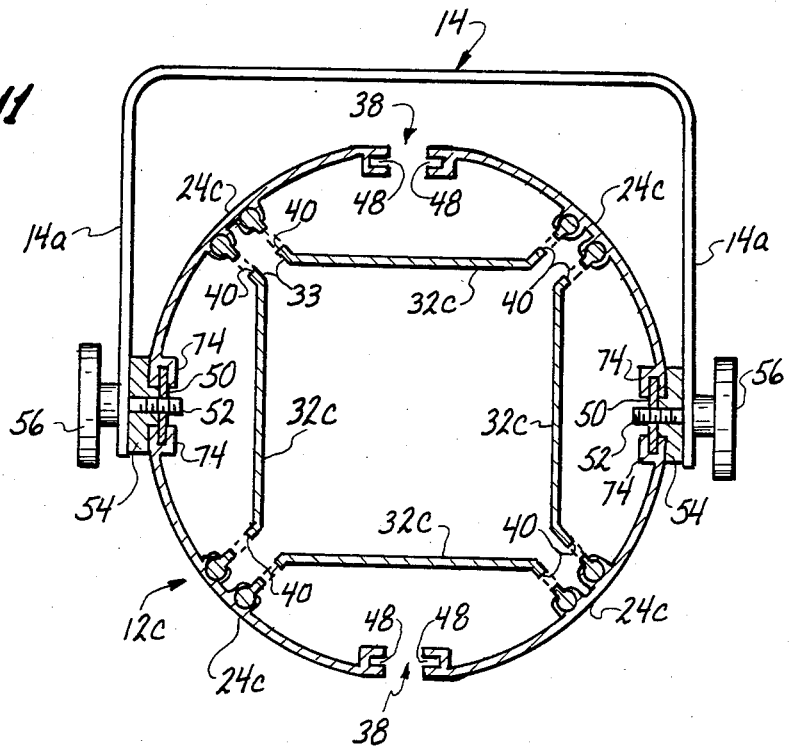

EXTRUDED LAMP HOUSINGS

BACKGROUND OF THE INVENTION

1. Field of the Invention

The present invention pertains to the field of artificial lighting fixtures and more particularly relates to a series of housings for high intensity lamps assembled from interlocking housing elements.

2. State of the Prior Art

Artificial lighting technology has evolved towards electrical light sources of increasing intensity and smaller physical size. The familiar incandescent light bulb with a tungsten filament glowing in an evacuated bulb is increasingly giving way to lampbulbs containing pressurized noble gases which allow the filament to be operated at considerably higher intensity and greater light output than was previously possible to provide higher quality and more energy efficient illumination than provided by conventional tungsten bulbs. These high intensity light sources tend to generate considerable amounts of heat in spite of their improved efficiency because of their compact physical dimensions. The small size of these light sources encourages the use of small or miniature size housings and enclosures which cannot efficient dissipate the heat generated by the light source. These fixtures therefore normally operate at relatively high temperatures and are limited in the wattage of the lamp which can be safely used. This is particularly true of lamps which require a low voltage/high current step-down transformer which contributes to the thermal load imposed on the housing. One solution adopted in the industry has been to mount the transformer outside and away from the housing to minimize the heat build-up.

High intensity light source are particularly popular as so-called track lights where an electrical supply rail is affixed to a ceiling or other surface and one or more lamp fixtures are slidably supported on the rail and draw power from the rail's electrical conductors. It is desirable to make such lamp housings compact in size in the interest of minimizing weight and for esthetic considerations.

A continuing need exists for high intensity lamp housings capable of good heat dissipation and which are also of simple, economic, durable and esthetically pleasing construction.

SUMMARY OF THE INVENTION

This invention addresses the aforementioned needs by providing a series of lamp housings for high intensity light sources suitable for either track mounted or surface mounted applications. The housings are primarily assembled from interlocking elements and are characterized by superior convective air flow cooling.

The novel lamp housings each include tow or more outer channel sections and one or more internal light baffles arranged between said outer channel sections. Each of the outer sections elements interlocking with other such elements on the baffle or baffles for assembling the channel sections in mutually parallel spaced apart relationship and form a tubular structure with longitudinal ventilation slots between the channel sections. The baffles have apertures defining with the ventilation slots an air flow path through the tubular structure, but the baffle apertures are offset in relation to the ventilation slots so as to contain stray light emitted by a lamp mounted to one end of the tubular structure. The interlocking elements preferably comprise longitudinally extending slidably mateable bosses on each of the outer channel sections and the inner light baffle or baffles. Advantageously, at least the outer channel sections are extrusions with the bosses formed integrally therewith. The lamp housing is completed by a lamp holder baffle closing one end of the tubular structure and an end plate closing the opposite end thereof.

The assembled housings have two or more ventilation slots extending longitudinally the full length of the housing to facilitate air flow through the housing interior. Further, the longitudinal vent slots slidably receive mounting hardware which can be positioned continuously at any point along the housing. This feature allows sliding displacement of a support bracket along the ventilation slots so as to flexibly position the housing in relation to the mounting bracket as circumstances may require.

The lamp housings according to the present invention each include two or more external housing sections interconnected by one or more inner light baffles or connecting elements.

The external housing elements are channel sections which may have any one of various cross-sectional shapes depending on the overall intended shape of the finished lamp housing. The inner light baffles may be rectangular plates. The external and internal elements interlock by means of mating longitudinally extending bosses integral to each. It is preferred that the external sections of the housing have female bosses on their inner surfaces and that the baffle plates have male bosses along parallel plate edges. The male bosses slide longitudinally into interlocking engagement with the female bosses on the external sections resulting in a generally tubular structure open at both ends in which the outer sections of the housing are held in mutually parallel spaced apart relationship so as to define ventilation slots extending the full length of the housing between the external housing sections. The baffle plates are perforated with air flow openings which are laterally offset in relation to the ventilation slots to establish an air flow path through the housing while containing stray light emitted within the housing by a lamp element mounted to one end of the tubular structure and also shielding the housing interior from exterior view.

The lamp housing is completed by attaching a lamp holder baffle to one open end and an end panel to close the opposite open end. One or both of the lamp holder baffle and the end panel may be conveniently attached by means of screws which thread into the female bosses on the external housing sections to thus secure together the external sections and baffle plates.

Both the external housing sections and the inner baffle plates may be economically fabricated by continuous extrusion methods in long lengths which can subsequently be cut into segments of appropriate length for assembly into individual lamp housings. These extrusions may include longitudinally oriented ornamental features such as stripes, grooves, etc. in addition to integrally formed interlocking longitudinal bosses of both genders. Not only is the fabrication of the housing components economical, but also the quick interlocking assembly minimizes the cost of the finished housing.

As another important feature, a bracket or other support can be easily and quickly attached to the lamp housing by means of a simple clamping arrangement adapted to engage and slide along the longitudinal edges of the external sections on either side of the ventilation slots. The slidable mounting hardware not only further facilitates assembly of the fixture but also provides increased versatility in its installation and use.

Lamp housings according to this invention may be constructed for example, from two external housing sections interconnected by two internal baffle plates to provide a two slot housing. A four slot housing may be obtained by interconnecting four appropriately constructed external housing sections with four internal baffle plates. While two and four section housings will meet most ordinary needs, still more complex housing constructions are possible, as well as housings with odd numbers of ventilation slots.

The cross-sectional geometry of the external sections of the housings may be selected so as to construct lamp housings of rectangular, cylindrical or still other cross-sections, and with two, three, four or more ventilation slots.

An attractive visual effect may be achieved in the lamp housings by allowing some stray light to leak within the housing around the front edge of the inner baffles, against the inside surface of the front end lamp holder baffle from which the light is reflected rearwardly onto the outer surface of the inner baffles. This reflected light is visible through the ventilation slots and appears as a bright accent stripe along the housing along each such slot.

These and other advantages of the present invention will be better understood from the following detailed description of the preferred embodiments considered with reference to the accompanying drawings.

BRIEF DESCRIPTION OF THE DRAWINGS

FIG. 4 is a longitudinal cross-section taken along line 4—4 in FIG. 2;

FIG. 5 is a vertical cross-section of the housing taken along lines 5—5 in FIG. 4;

FIG. 6 is a cross-section taken along line 6—6 in FIG. 5;

FIG. 6A is an enlarged fragmentary cross-section of a matable set of interlocking bosses.

FIG. 10 shows the cylindrical housing of FIG. 9 provided with a U-shaped mounting bracket in lieu of the support rod;

FIG. 11 shows a four slot cylindrical housing provided with a U-shaped mounting bracket.

DETAILED DESCRIPTION OF THE PREFERRED EMBODIMENTS

Figure 1:
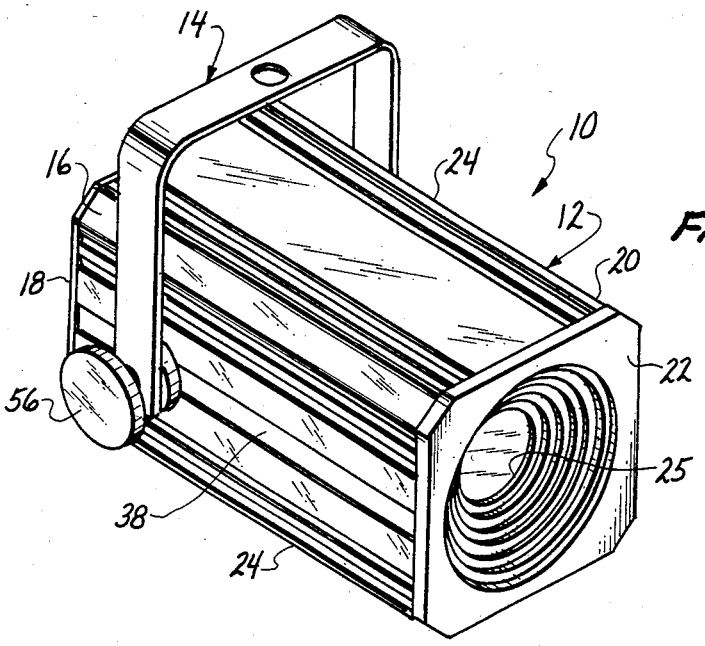
FIG. 1 is a perspective view of a two slot lamp housing provided with a U-shaped mounting bracket.
Figure 2:
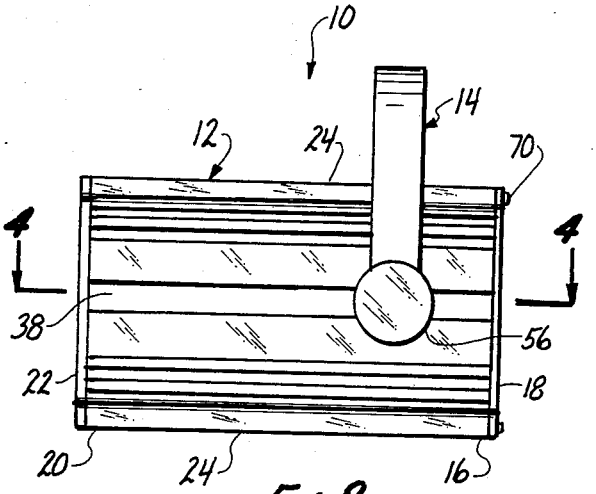
FIG. 2 is side elevational view of the housing of FIG. 1.
Figure 3:
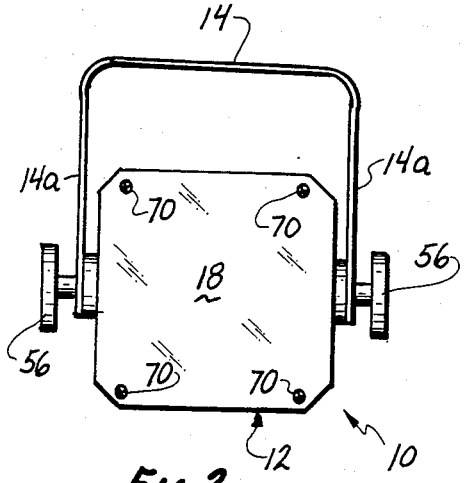
FIG. 3 is a rear end view of the housing of FIG. 1.

With reference to the drawings, FIGS. 1–6 show a lamp fixture 10 which consists of a lamp housing 12 and a U-shaped mounting bracket 14. The lamp housing 12 has a rear end 16 closed by an end plate 18, and a front end 20 to which is mounted a lamp holder baffle 22. As best seen in the cross-section of FIG. 6, the housing 12 includes two external channel sections 24 each of generally U-shaped cross-section and arranged with their concave inner sides 26 facing each other. The two external sections 24 are interconnected and supported in mutually parallel but spaced apart relationship by two inner baffle plates 32. The channel sections 24 and plates 32 interlock by means of mating longitudinal bosses. Each channel section 24 has two longitudinally extending female bosses 30 formed on its inner side 26 while each baffle plate 32 has male bosses 34 extending along two parallel plate edges. As better seen in the detail view of FIG. 6A each female boss 30 is a structure which defines a small diameter cylindrical duct 30*a* open at both ends and also along a slot 30*b*. The bosses 30 are parallel to each other and run the full length of each housing section 24. The male bosses 34 are cylindrical enlargements along the plate edges and make a close longitudinal sliding fit within the females bosses 30 on the housing sections 24 until the plates 34 are contained between the two housing sections 24 as shown in FIGS. 1–6. The longitudinal edges 36 of the two external channel sections 24 remain spaced apart and define between them two ventilation slots 38 extending the full length of the housing 12.

Each inner baffle plate 32 has a row of air flow baffle openings 40 adjacent to each plate boss. In the assembled housing the baffle openings 40 are laterally offset in relation to the ventilation slots 38 as best understood from FIGS. 4 and 5 so as to avoid forming a line of sight opening into the interior of the housing 12. Visual access to the interior of the lamp housing and emission of stray light through the ventilation slots 38 is closed-off by the solid unperforated center portion of the plates 32. Nevertheless, air is free to flow unimpeded into and through the lamp housing interior through the ventilation slots 38 and the two rows of plate openings 40.

Figure 7:
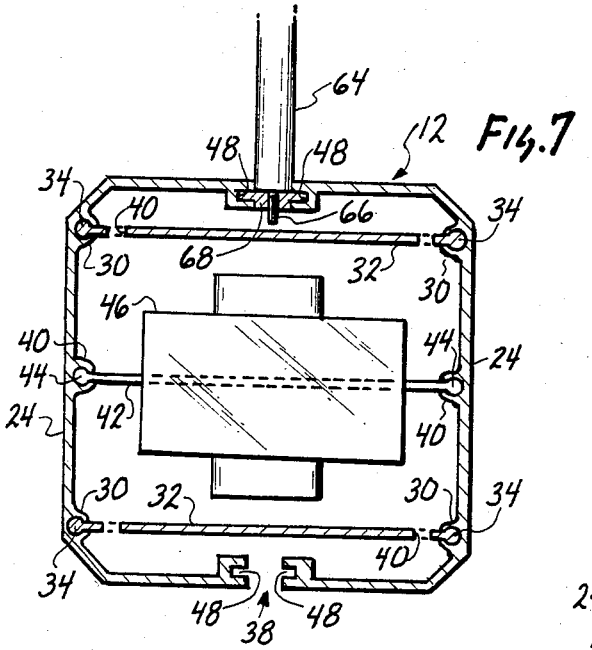
FIG. 7 illustrates in cross-sectional view the attachment of a single ended mounting rod to the housing of FIGS. 1–6 in lieu of the U-shaped mounting bracket.

A third female boss 30′ may be provided on each housing section 24 intermediate the two bosses 30 for the purpose of accepting the edges of a carrier plate 42 shown in FIG. 7 provided with male bosses 44 along its parallel longitudinal edges. The carrier plate 42 may serve a variety of purposes as a mounting board for electrical or electronic components. For example, where the housing 12 is intended for a low voltage/high intensity lamp, the carrier plate 42 may support a transformer 46 for stepping down the A/C line voltage to the low voltage required by the lamp element in such cases. The transformer 46 can thus be supported approximately in the center of the housing 12 where it is best exposed to contact with air flowing through the housing 12.

Along the longitudinal edges of the external channel sections 24 on either side of the ventilation slots are longitudinal grooves 48 which receive and cooperate with a clamping arrangement on each arm 14*a* of the mounting bracket 14. This clamping arrangement includes a nut 50 slidably captive between two grooves 48 on opposite edges of the ventilation slots 38 and held against rotation between the two housing sections 24. A screw 52 provided at its outer end with a knurled knob 56 passes freely through the arm of the mounting bracket and through an outer washer 54. The washer 54 is keyed to the ventilation slot and is slidably held against rotation therein, and also spans the ventilation slot 38 and bears against the outer surfaces of both housing pieces 24 on each side of the slot 38. The inner end of the screw 52 is threaded through the nut 50. If the screws 52 are loosened the housing 12 is free to pivot about the axis of the screws 52. When the knob 56 is turned to tighten the screw 52 the nut 50 and the washer 54 are drawn together thereby clamping the edges of housing 12 against rotation about the axis of screws 52 to fix the housing 12 at a selected angle in relation to the bracket 14.

The mechanical assembly is completed by attaching the end plate 16 to one end 18 of the housing and fitting the lamp carrier 22 to the opposite end 20 of the housing 12. Electrical assembly of the unit is conventional with connections from the transformer unit 46 to the lamp element 45 in the lamp carrier 22 by means of a suitable commercially available connector 47, and with the transformer 46 connected to an A/C power cord 49 which may conveniently extend through a grommeted hole 51 in the end plate 18. If the lamp operates at line voltage it is connected directly to the A/C power cord. In FIGS. 4 and 5 the transformer 46 is shown mounted to the end plate 18 instead of a carrier plate as shown in FIG. 7.

From the foregoing description it will be appreciated that assembly and mounting of the housing 12 is greatly simplified and facilitated by various structural features and elements formed integrally with the housing sections 24. These elements including bosses 30 and 30', and grooves 48 extend continuously longitudinally along each housing section 24 between the front end 20 and rear end 18, and these features are therefore readily formed by continuous extrusion processes integrally and simultaneously with extrusion of the housing sections 24. The baffle plates 32 with plate bosses 34 may also be formed by continuous extrusion processes. The baffle apertures 40 however are subsequently formed as an additional step in plate fabrication. Both the outer housing sections and the internal baffle plates 32 are preferably made of extruded aluminum, a durable, attractive material which is also a good heat conductor. While the baffle plates are preferably provided with male bosses as shown and described, it is also within the scope of this invention to provide baffle plates with normally squared side edges in which case the female bosses 30, 30' on the outer sections are shaped to closely receive these edges.

The lamp housing 12 is quickly and easily assembled by merely sliding the edges of the two inner baffle plates 32 into corresponding bosses 30 on the two housing sections 24. The carrier plate 42 if one is needed is likewise slid into interlocking engagement between its corresponding bosses 30'. Finally, the bracket 14 is attached by sliding the retaining nuts 50 into the grooves 48 along each slot 38 and securing the bracket arms to the nuts 50 by means of screws 52. While the fixture 10 illustrated in FIGS. 1–5 shows a U-shaped bracket 14 with two arms and therefore supported by two nuts 50, one on each side of the housing 12, an alternative one-armed mounting bracket may be attached to the lamp housing 12 on one side only by means of a single screw 52 and nut 50.

A further advantage derived from the extruded design of the lamp housing is the possibility of continuously slidably positioning the supporting bracket 14 or other supporting hardware at any point between the front and rear ends of the housing by merely loosening the screws 52 and sliding the nuts 50 to any desired position along the grooves 48 in the ventilation slot 38 and then fixing the bracket at the new position and at a desired angle relative to the housing by tightening the screws 52.

Figure 8:
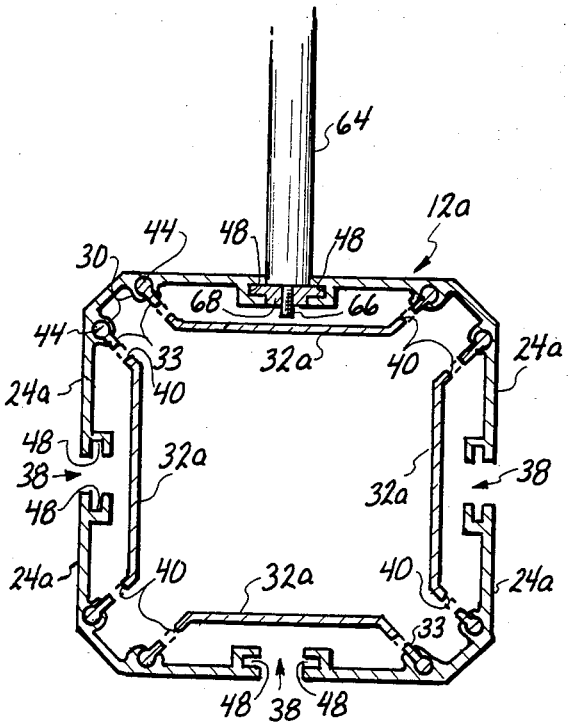
FIG. 8 illustrates in cross-sectional view a four slot housing of rectangular cross-section and provided with a single ended mounting rod.
Figure 9:
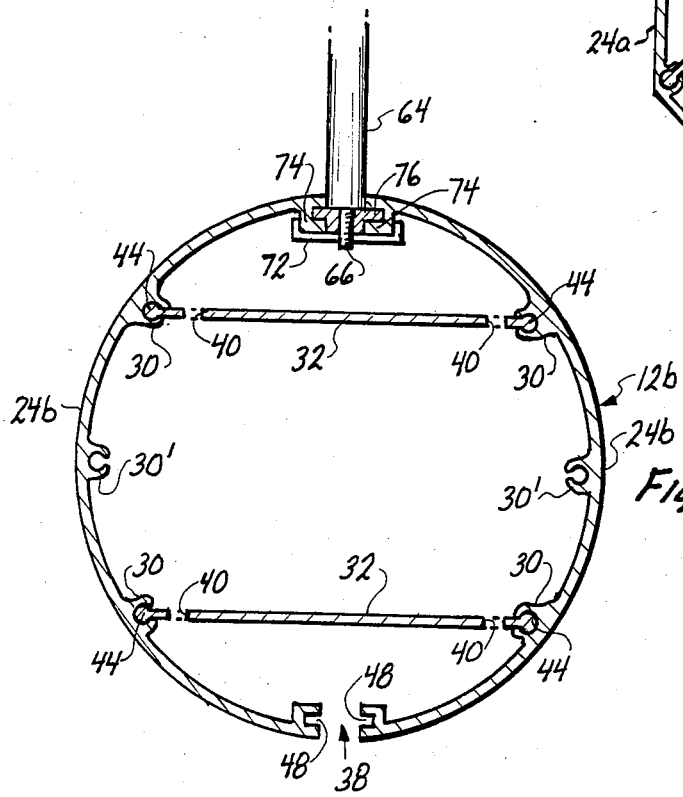
FIG. 9 shows a two slot housing of cylindrical cross-section provided with a single ended support rod.

The lamp housing 12 is easily adapted to a variety of mounting brackets and supports other than the U-shaped or one-armed brackets already described. For example, the housing 12 may be supported at the end of a mounting rod or tube 64 as shown in FIGS. 7 through 9. For mounting to the end of a rod or similar support, the housing 12 is rotated 90 degrees such that one of the ventilation slots 38 receives the end of the support rod 64. The rod 64 terminates in a screw section 66 which is threaded through a rectangular nut 68 captive within but slidable along grooves 48 defined in the two housing sections. The nut 68 is held against rotation between the housing sections and the screw 66 extends through the nut and bears against the underlying inner plate. When the screw 66 is turned the nut 68 is drawn up against the rod end and the edges of the two housing sections are clamped between the nut and the annular end surface 74 defined about the screw 66 at the end of the mounting rod 64, thereby securing the rod 64 the housing 12 to the rod 64. In this attitude convective air flow through the housing 10 is particularly advantageous since hot air from its interior will rise and escape through the upper ventilation slot and be replaced by cooler ambient air drawn in through the lower vetilation slot.

The lamp holder baffle 22 may be a die cast metal element with a central opening 25 through which a beam of light is projected by a lamp element 45 held in place by a retainer spring clip 43. Either or both the front baffle 22 and end plate 18 may be conveniently secured to the extruded housing 12 by means of screws such as sheet metal screws 70 threaded into the open ends of the female bosses 30, without need for drilling separate screw holes in the extruded sections 24. In the alternative, either or both the lens holder 22 and end plate 18 may be retained to the housing 12 by suitable spring or friction retainer elements or any other suitable means.

The lamp element 45 may be a commercially available tungsten halogen lamp or Dichro-cool lamp, both with integral reflector which however are designed to allow some light to pass through the reflector rearwardly into the housing interior. A visually attractive effect can be obtained by allowing some of this stray light to illuminate the inside surface 29 of the front baffle 22 which in turn reflects the light onto the outer surface 33 of the inner baffle plates 32 as best understood by reference to FIGS. 4 and 6. The illuminated baffle surfaces 33 are only visible through the ventilation slots and thus appear as glowing accent stripes along the housing exterior when the lamp 45 is lit. This effect may be achieved for example by terminating the front edges 37 of the baffle plates short of the front baffle surface 29, thus creating a gap through which the lamp 45 may illuminate surface 29 as shown in FIGS. 4 and 5.

The present invention is easily extended to lamp housings of various cross sectional geometries as suggested by way of example but without limitation in FIGS. 8–11 and 13*a*–13*i*.

FIG. 8 shows a lamp housing 12*a* of generally rectangular or "soft square" cross-section which is assembled from four external channel sections 24*a* each of which is of generally right angle cross-section. The four external sections 24*a* are assembled into a rectangular structure by means of four inner baffle plates 32*a* which have angled margins 33 and longitudinal male bosses 44 which interlock with female bosses 30 on each of the external sections 24*a* in a manner analogous to that described with the housing 12 of FIGS. 1–7. The four sections 24*a* are supported in mutually parallel but spaced apart relationship so as to define four ventilation slots 38 extending longitudinally the full length of the housing 12*a*, one slot on each of the four side faces of the housing. Each slot is defined between the longitudinal edges of adjacent external sections 24*a* with grooves 48 provided in these longitudinal edges for receiving a nut 68 in any of the four slots 38 in the manner already described in connection with FIG. 7 for attaching mounting hardware such as the rod 64 to the housing 12*a*. The construction and component parts of this housing will better understand by reference to FIG. 12 which shows in exploded form the four external channel sections 24*a*, the four inner baffle plates 32*a*, the lamp holder baffle 22 and end plate 18 which together constitute the housing 12*a* ready for attachment to suitable mounting hardware after installation of the electrical components in the housing.

FIG. 9 illustrates a housing 12*b* of cylindrical cross-section made up of two semi-cylindrical external channel sections 24*b* interlocking by means of female bosses 30 with male bosses 44 provided on inner connecting baffle plates 32. The two cylindrically curved outer sections 24*b* are spaced apart along their edges so as to define two ventilation slots between the housing sections. It will be understood that the baffle plates 32 are perforated in the manner already explaied in connection with FIGS. 1–6 so as to permit free air flow through the housing while containing stray light. In FIG. 9, a mounting rod 64 is shown engaged within the upper ventilation slot 38 by means of mounting hardware which includes a screw 66 extending from the lower end of the rod 64 and threaded through a nut 72 internal to the housing and bearing against the inside surfaces of groove defining lips 74. The screw 66 passes freely through a hole in a member 76 which is slidably captive within the grooves 48 on either side of the upper ventilation slot. By turning rod 64, the screw 66 is threaded into the nut 72, drawing the nut up against the housing portions 74 and also urging the element 76 against portion 74 thereby achieving a clamping effect which secures the rod 64 to the housing 12*b*.

The housing 12*b* is shown with female bosses 30' ready to accept a carrier plate 42 such as shown in the square housing of FIG. 7, if such carrier plate is desired.

FIG. 10 shows the housing 12*b* as in FIG. 9 but attached to a U-shaped mounting bracket 14 and associated hardware which forms a clamping arrangement for attachment to the housing 12*b* in a manner analogous to that described in connection with the housing 12 in FIGS. 1–5.

Figure 12:
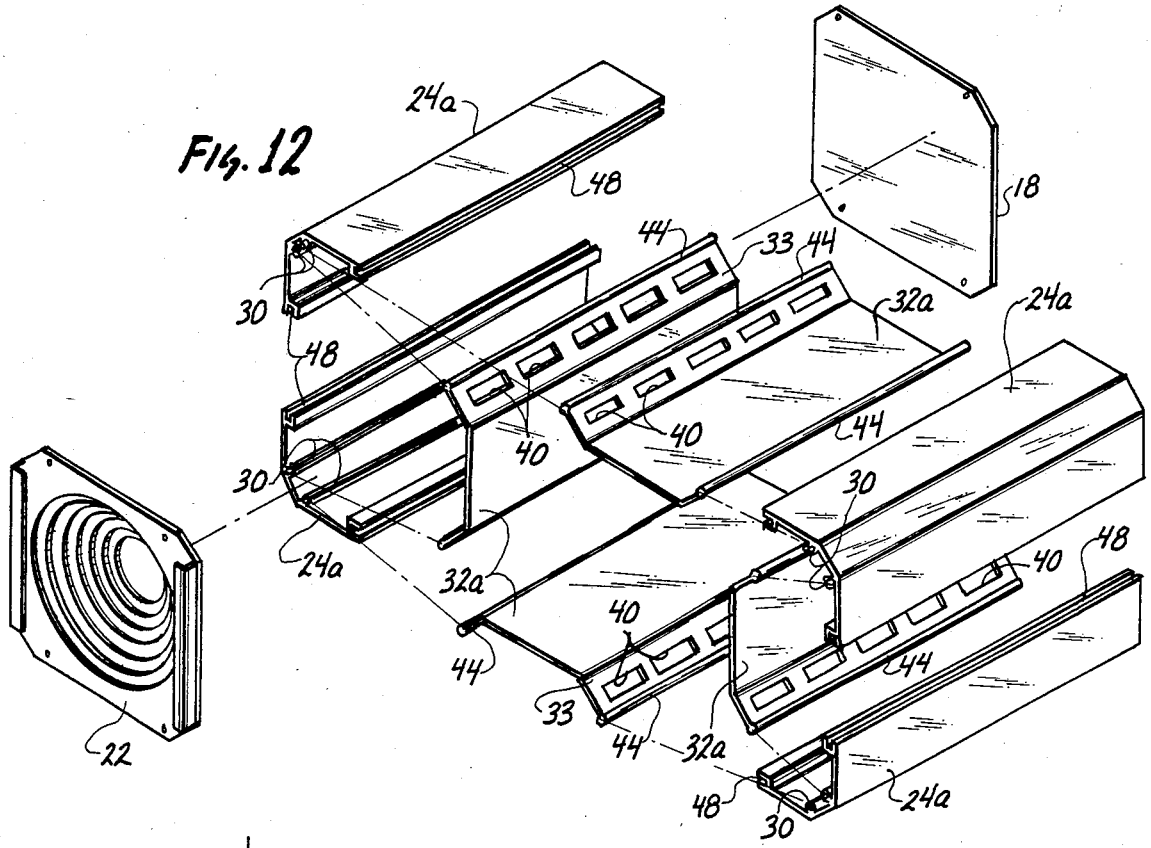
FIG. 12 is an exploded perspective view of a four slot housing of rectangular cross-section.

FIG. 11 shows a cylindrical lamp housing 12*c* which includes four quarter cylindrical outer channel sections 24*c* interlocked with an held in spaced parallel relationship by means of four apertured inner baffle plates 32*c* in a manner similar to the assembly of the four slots rectangular housing of FIGS. 8 and 12, the two housings differing primarily to the cross-sectional geometry of the four external channel sections. The cylindrical lamp housing of FIG. 11 is mounted to a U-shaped bracket 14 provided with associated hardware which slides along two diametrically opposed ventilation slots 38 as already described in connection with FIGS. 1–5. In the housing of FIG. 11, the other two ventilation slots 38, at the top and bottom of the housing remain open and provide vertical convective air flow through the housing. It will be understood that in all cross-sectional illustrations of FIGS. 6–11, the inner baffles plates are perforated with baffle apertures 40 arranged substantially as in FIG. 5 in the case of flat baffle plates or as in FIG. 12 in the case of the bent baffle plates, so as to provide an air flow path through the housing in conjunction with the longitudinal ventilation slots 38 while in all cases containing stray light emitted within the housing by lamp element such as lamp 45 in FIGS. 4 and 5.

Figure 13:
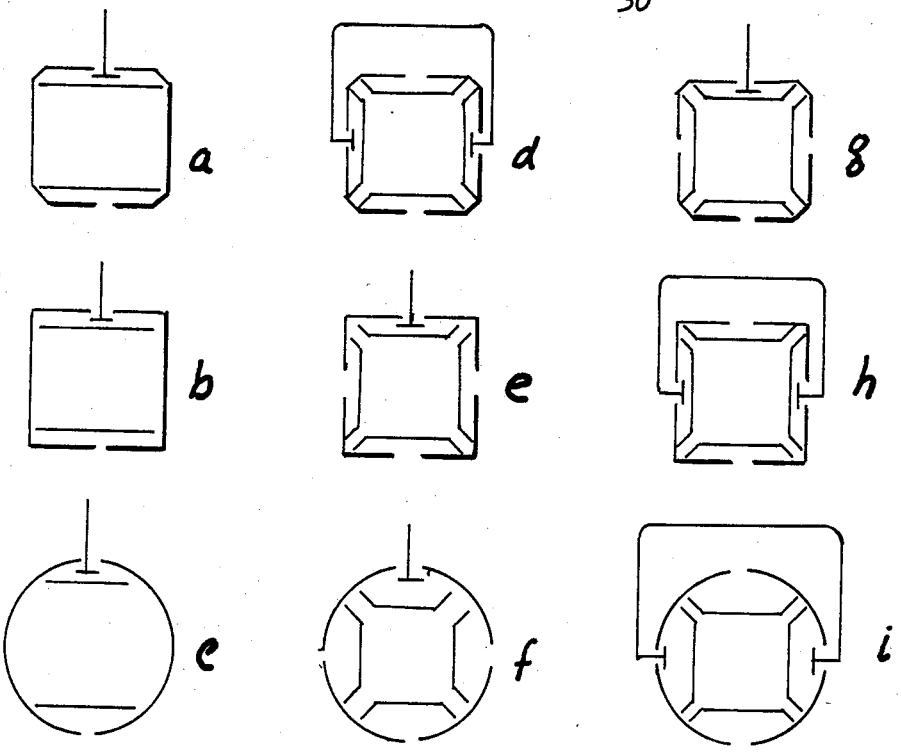
FIGS. 13*a*–13*i* illustrate in schematic cross-section a variety of lamp housing configurations achievable according to this invention.

FIG. 13 shows in schematic form some of the many cross-sectional housing configurations possible according to this invention. The illustrations include two slot housings 13*a*, 13*b*, 13*c*, four slot housings 13*d*–13*i*, "soft-square" housings 13*a*–13*g*, square housings 13*b*, 13*e*, 13*h*, cylindrical housings 13*c*, 13*f*, 13*i*. The various brackets are shown supported by U-shaped mounting brackets in FIGS. 13*d*, 13*h* and 13*i* while the remaining housings are shown supported by single ended mounting rods. The two slot housings are shown with flat or planar inner baffle plates while the four slot housings are shown with inner baffle plates with angled margins such as margins 33 in FIGS. 8 and 12.

Although a series of various shapes has been described and illustrated by way of example, it must be understood that the nature of the invention is such as to make possible many other lamp housing constructions other than those specifically disclosed herein without thereby departing from the essence of the invention which makes possible the low cost fabrication and assembly of lamp housings of pleasing appearance and superior practical value. The scope of the invention is therefore to be defined only by the following claims.

What is claimed is:

1. A lamp housing comprising:
a first plurality of external channel sections;
a second plurality of internal baffle elements; and
interlocking means on said sections and elements mateable for assembling said channel sections in mutually parallel spaced apart relationship to form a tubular structure having longitudinal ventilation slots between said channel sections.

2. The housing of claim 1 wherein said interlocking means comprise longitudinally extending bosses of a first gender on said channel sections and bosses of a second gender on said internal baffle elements.

3. The housing of claim 2 wherein said external channel sections are extrusions and said bosses of first gender are formed integrally therewith.

4. The housing of claim 3 wherein said internal baffle elements are extrusions with said bosses of second gender formed integrally therewith.

5. The housing of claim 3 wherein said internal baffle elements are plates apertured to define an air flow path through said tubular structure between said ventilation slots, said apertures being offset in relation to said ventilations slots so as to contain stray light emitted by a lamp mounted to one end of said tubular structure.

6. The housing of claim 5 wherein said plates are extrusions with said bosses of second gender formed integrally therewith.

7. The housing of claim 1 further comprising additional boss means on said external channel sections for interlocking with a carrier plate inserted between said internal baffle elements.

8. The housing of claim 7 further comprising a carrier plate engageable with said additional boss means for supporting power supply means such as a transformer within said tubular structure.

9. The housing of claim 1 further comprising a lamp holder baffle closing one end of said tubular structure and an end plate closing the opposite end thereof.

10. A lamp housing comprising:

plurality of outer channel sections;

internal light baffle means arranged between said outer channel sections;

interlocking means on said outer sections and said baffle means for assembling said channel sections in mutually parallel spaced apart relationship forming a tubular structure with longitudinal ventilation slots between said channel sections; and apertures in said baffle means defining with said ventilation slots an air flow path through said tubular structure, said apertures being offset in relation to said ventilation slots so as to contain stray light emitted by a lamp mounted to one end of said tubular structure.

11. The housing of claim 10 wherein said interlocking means comprise longitudinally extending slidably meteable bosses on each of said outer channel sections and said inner light baffle means.

12. The housing of claim 11 wherein at least said outer channel sections are extrusions with said bosses formed integrally therewith.

13. The housing of claim 10 further comprising a lamp holder baffle closing one end of said tubular structure and an end plate closing the opposite end thereof.

14. The housing of claim 10 further comprising mounting means including clamp means, said clamp means being attacheable to the housing for supporting the housing in fixed relationship to said mounting means, said clamp means being releasable for sliding movement along one or more of said ventilation slots thereby to selectively position said mounting means at any point continuously along the housing.

15. The housing of claim 14 wherein said outer channel sections have grooved edges along each side of said ventilation slots and said clamp means are slidable within said grooves.

16. The housing of claim 13 wherein said inner baffles are configured to allow a lamp mounted to said lamp holder baffle to illuminate the inner surface of the lamp holder baffle which inner surface then reflects the light onto the outer surface of said inner baffles thereby achieving the visual effect of glowing accent stripes along said ventilation slots of the housing.

* * * * *